US005853656A

United States Patent [19]

Besterman et al.

[11] Patent Number: 5,853,656

[45] Date of Patent: Dec. 29, 1998

[54] APPARATUS AND METHOD FOR COOLING A BASIC OXYGEN FURNACE TRUNNION RING

[75] Inventors: C. David Besterman, Valparaiso; Kelan J. Nowak, LaPorte; Leon R. Brown, Crown Point, all of Ind.

[73] Assignee: Bethlehem Steel Corporation, Del.

[21] Appl. No.: 889,857

[22] Filed: Jul. 8, 1997

[51] Int. Cl.[6] ..... C21B 7/16

[52] U.S. Cl. ..... 266/47; 266/241; 266/246

[58] Field of Search ..... 266/47, 241, 246, 266/245

[56] References Cited

U.S. PATENT DOCUMENTS

| | | | |
|---|---|---|---|
| 3,163,695 | 12/1964 | Bumberger | 266/36 |
| 3,304,075 | 2/1967 | Puxkandi | 266/36 |
| 3,345,058 | 10/1967 | Pere | 266/36 |
| 3,588,072 | 6/1971 | Matsumoto et al. | 266/36 |
| 3,601,379 | 8/1971 | Langlitz et al. | 263/44 |
| 3,679,195 | 7/1972 | Coulter et al. | 266/35 |
| 3,687,436 | 8/1972 | Wortman | 266/35 |
| 3,966,180 | 6/1976 | Patuzzi et al. | 266/158 |
| 4,278,241 | 7/1981 | Shadid | 266/241 |
| 4,815,096 | 3/1989 | Burwell | 266/241 |
| 5,290,016 | 3/1994 | Elsner | 266/241 |
| 5,611,990 | 3/1997 | Langlitz et al. | 266/241 |
| 5,653,936 | 8/1997 | Enkner et al. | 266/241 |

FOREIGN PATENT DOCUMENTS

| | | |
|---|---|---|
| 0413925 | 6/1990 | European Pat. Off. . |
| 57-032317 | 2/1982 | Japan . |
| 1-104712 | 4/1989 | Japan . |

OTHER PUBLICATIONS

Iron and Steel Engineering, Nov. 1993, Development of the Hi–Vap BOF cooling system, Nell J. Goodman, et al.

PCT International Search report, PCT/US98/01212, priority based upon US 08/889,857, Jan. 1998.

*Primary Examiner*—Scott Kastler

*Attorney, Agent, or Firm*—Harold I. Masteller, Jr.

[57] ABSTRACT

A method and apparatus for cooling a BOF trunnion ring by vaporization. A water mist is injected into the interior space of the trunnion ring where it is vaporized. The heat transfer of vaporization cools the trunnion ring, and the hot vapor is vented from the trunnion ring to the atmosphere.

28 Claims, 3 Drawing Sheets

Fig. 1
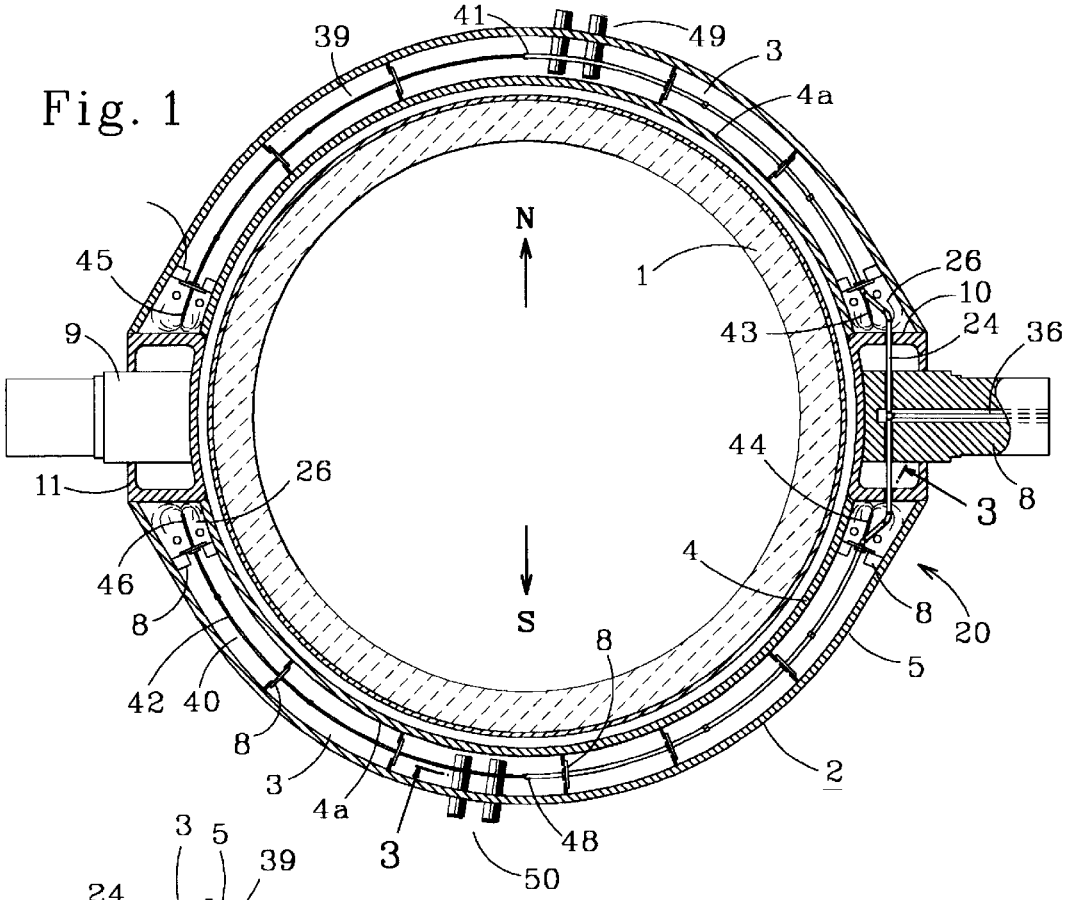
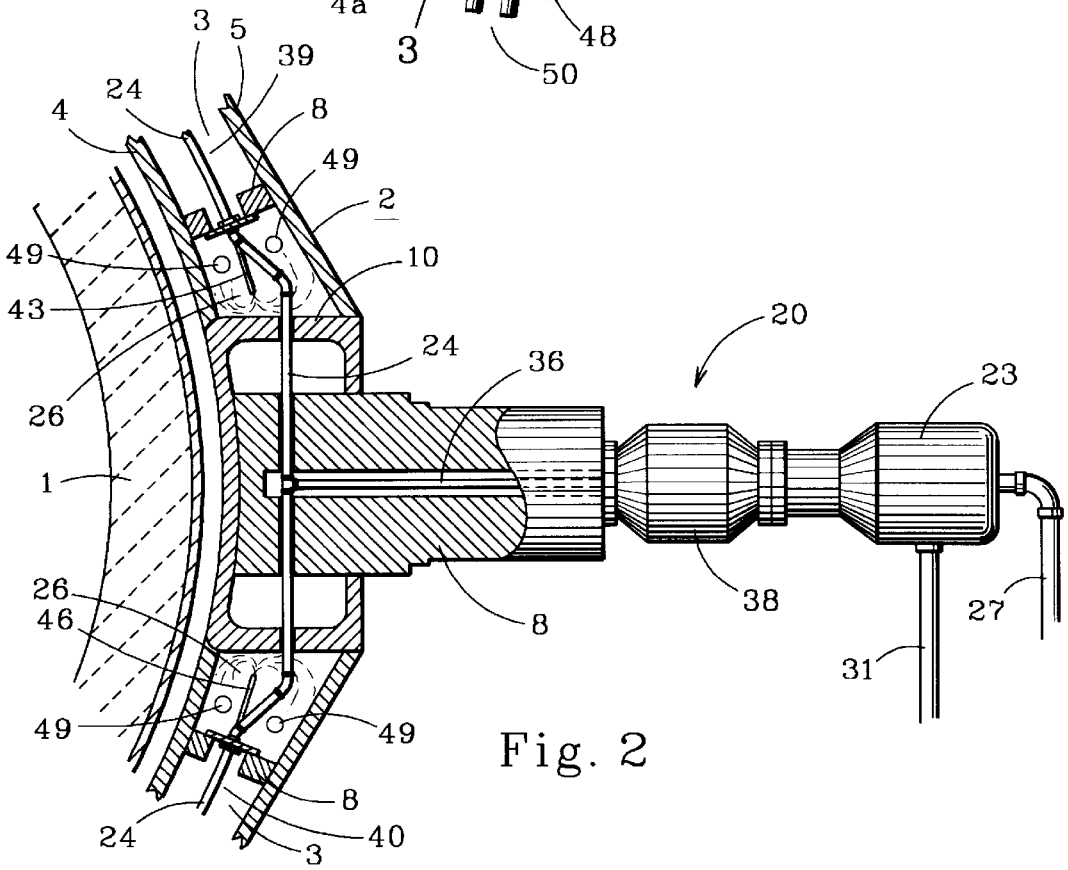
Fig. 2

24
8
38
23
36
1
10
35
30
20
34
28
33
29
22
31
32
21
27
28

APPARATUS AND METHOD FOR COOLING A BASIC OXYGEN FURNACE TRUNNION RING

BACKGROUND OF THE INVENTION

This invention is directed to a method and apparatus for cooling the trunnion ring in a basic oxygen furnace, and more particularly, the invention is directed to a method and apparatus in which a water mist is vaporized and the heat transfer of vaporization is used to cool the trunnion ring. The cooling apparatus includes a conduit that extends into the interior space of a trunnion ring and discharges a water mist against a hot interior surface. The water mist is vaporized upon contact with the hot surface, and the heat transfer cools the trunnion ring. The hot water vapor is discharged from the interior space through vents that extend through the trunnion ring web plate.

A basic oxygen furnace (BOF) can be expected to have a service life from between about seven to fifteen years, depending on production levels at the steelmaking operation. One major type failure that shortens service life is uncontrolled thermal expansion throughout the BOF structure, and in particular, uncontrolled expansion in the vessel shell. As the outside shell of a BOF vessel distorts, typically along the tap-charge direction, the clearance space between the shell and the trunnion ring that encircles the shell, is reduced. When shell distortion reaches a point where the clearance between the shell and ring becomes close to, or is zero, failure of the trunnion ring and the shell can be expected.

Trunnion ring cracking is another type of thermal related problem that reduces BOF service life. Cracking of the trunnion ring structure is associated with severe thermal conditions under which a BOF is operated. Thermal shock stress, and large temperature differentials, produce unequal expansion between structural components and cause structural connections to fatigue and fail.

Failures caused by uncontrolled thermal expansion can be reduced if cooling systems are employed to transfer heat away from refining vessel. Many past BOF designers have attempted to extend service life by utilizing water-cooling systems to lower the operating temperatures of their vessels. Some present water-cooling systems are effective in controlling temperature at the furnace lip, at the cone portion below the furnace lip, and at the trunnion ring, including the trunnion pins upon which the vessel is rotatably supported.

Water-cooling a trunnion ring involves feeding the cold water into one of the trunnion pins, circulating the cooling water throughout the interior space of the trunnion ring, and discharging the water through the opposite trunnion pin. The heat transfer benefits of the circulating cooling water through a trunnion ring have been significant in both reducing thermal related failures as well as extending service life between furnace rebuilds. However, enclosed water-cooling systems introduce hazardous conditions at steelmaking operations. When a closed water-cooling system is located immediately adjacent the hot shell of a BOF vessel, the water has a propensity to explode in the event of accidental contact with the molten metal being refined.

For example, the outside steel shell of a BOF vessel is protected from high steel refining temperatures by a thick refractory lining. However, there are recorded instances where the molten steel has burned through the refractory lining and outer steel shell of the vessel. Such failures result in violent eruptions of molten metal from the steelmaking vessel. If the erupting steel penetrates the trunnion ring, it causes the cooling water to instantaneously vaporize, and the expanding steam produces a massive explosion with considerable damage to the furnace and surrounding facility.

In a recent United States patent, granted to Langlitz, the inventor discloses a water-cooled trunnion ring where water is circulated at high speed through a pipe coil system located within the trunnion ring. Because the pipe coil arrangement is located within the interior space of a trunnion ring, adjacent the hot steelmaking vessel, Langlitz fails to eliminate the hazardous conditions associated with confined cooling water adjacent a hot furnace. A furnace burn-through could rupture the pipe coil and cause the violent steam explosion as described above. The Langlitz pipe coil is very complex, it is expensive to manufacture and repair, and the pipe coil system is prone to water leaks along the long continuous welds shown in FIGS. 2*a*, 2*b*, and 2*d* of Langlitz's drawings. Additionally, a high speed cooling water system is environmentally unsound because it increases water consumption.

A different United States patent, granted to Bumberger, shows a water-cooled trunnion ring of the past where the interior space of the trunnion ring is completely filled with cooling water. As discussed above, such large volumes of confined water adjacent a hot furnace produces an extremely hazardous condition.

SUMMARY OF THE INVENTION

Accordingly, it is a first object of the present invention to provide a water vapor cooling system for a trunnion ring to reduce hazardous conditions at a steelmaking operation.

Another object of the present invention is to provide a water mist supply for the water vapor cooling system.

It is a further object of this invention to provide a cooling system where a water mist is injected into the interior space and vaporized so that the heat transfer of vaporization cools the trunnion ring.

Other objects and advantages of the present invention will become apparent as a description thereof proceeds.

In satisfaction of the foregoing objects and advantages, the present invention provides a method and apparatus for cooling a BOF trunnion ring by vaporizing a water mist. A water mist is injected into the interior space of the trunnion ring where it is vaporized upon contact with hot interior surfaces. The heat transfer of vaporization cools the trunnion ring, and hot vapor is vented into the atmosphere.

BRIEF DESCRIPTION OF THE DRAWINGS

FIG. 2 is an enlarged view of a portion of the cooling apparatus shown in FIG. 1.

DETAILED DESCRIPTION OF THE PREFERRED EMBODIMENT

Figure 3:
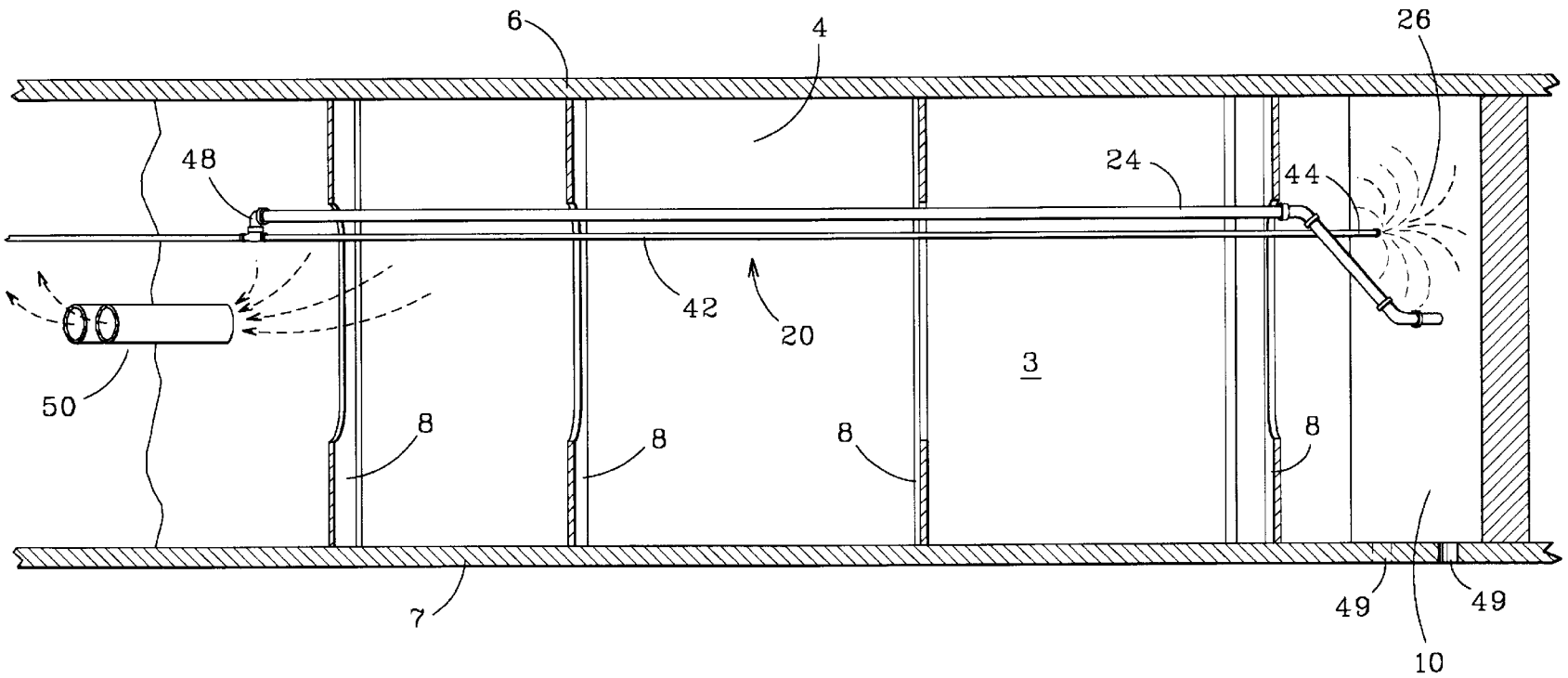
FIG. 3 is an enlarged cross-section taken along the lines 3—3 of FIG. 1.
Figure 4:
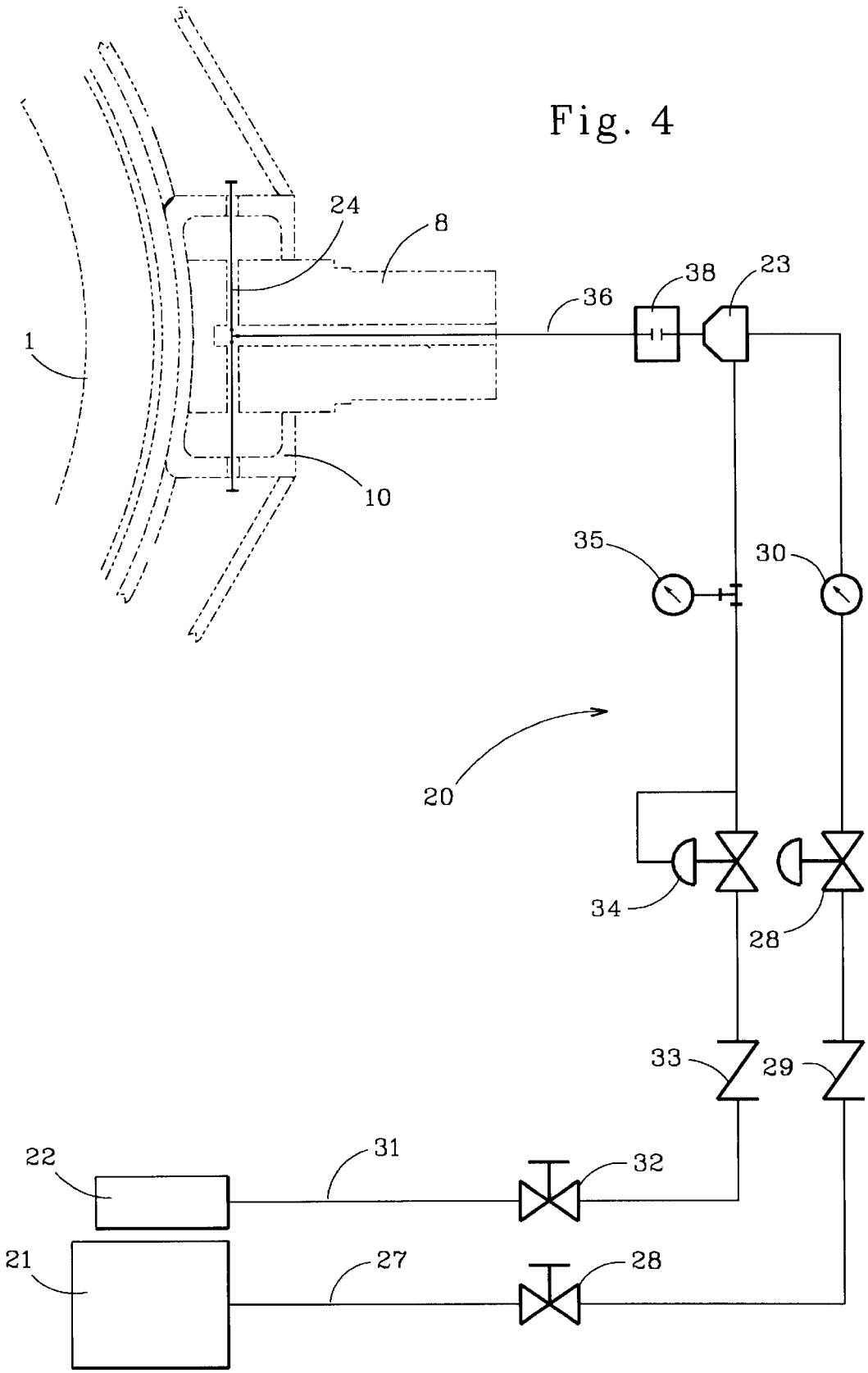
FIG. 4 is a schematic diagram showing one possible piping arrangement for the cooling apparatus of the present invention.

Past metallurgical furnaces have utilized a variety of water-cooled structures to support hot refining vessels. One such support structure is the trunnion ring that supports a BOF vessel. A BOF trunnion ring, as well as the related mechanism that helps support and operate the furnace, are water-cooled to prevent thermal stress that leads to structural failure. Past water-cooled trunnion rings have successfully reduced temperature related structural failures. However, as pointed out in the background of this invention, when cooling water is circulated through the interior spaces of a trunnion ring, adjacent a hot BOF, the confined water introduces a hazardous condition. This is because closed water systems will explode if there is accidental contact with the molten metal contained within the refining vessel. Such accidental molten metal contact can occur if there is a vessel burn-through. For example, in a burn-through, the molten steel that erupts from the vessel can penetrate the trunnion ring and causes a violent explosion by instantaneously vaporizing the water into steam.

Referring to FIGS. 1 through 4, the drawings show the preferred cooling apparatus 20 of the present invention. In the preferred embodiment, the cooling apparatus is shown installed within the interior space 3 of a trunnion ring 2 that encircles and supports a BOF vessel 1. The interior space of a trunnion ring is defined by an inside web 4 located adjacent the outside steel shell of the BOF vessel 1, an outside web 5 spaced apart from the inside web, a top flange 6 and a bottom flange 7. The top and bottom flanges, shown more clearly in FIG. 3, extend between the inside web 4 and the outside web 5. A plurality of interior stiffener plates 8 extend between the inside and outside webs to strengthen the trunnion ring assembly.

Although the preferred embodiment is shown cooling a BOF trunnion ring, it should be understood that the present invention can be used to cool the interior space of any structure located adjacent a variety of hot refining vessels or furnaces without departing from the scope of this invention.

The cooling apparatus 20 comprises a water supply 21, a pressurized air supply 22, a supersonic nozzle 23 that generates an air/water mist, a header 24 for distributing the air/water mist, and a conduit arrangement extending along the inside chamber 3 of the trunnion ring 2 and including mist discharge nozzles 26.

The supersonic nozzle 23 receives a flow of water from supply 21 at a flow rate of between about 5 to 25 gallons per hour (0.08–0.42 gpm) with a preferred water flow rate being at about 15 gallons per hour (0.25 gpm). At the same time pressurized air is fed into nozzle 23 from the pressurized air supply 22 at a flow rate of between 75 to 125 SCFM and at a pressure of between about 20 to 40 psi. A preferred air flow is about 100 SCFM at about 30 psi.

Water is fed to the supersonic nozzle 23 from the water supply 21 via water line 27, and the water flow is monitored and regulated through a series of valves 28, a check valve 29, and a flowmeter 30. Similarly, the pressurized air is fed to the supersonic nozzle from the pressurized air supply 22 via air line 31, and the pressurized air is monitored and regulated through series of control devices that include a valve 32, a check valve 33, a pressure regulator 34 and a pressure gauge 35.

The supply of air and water enters a mixing chamber in nozzle 23, and narrowing nozzle walls accelerate and disintegrate the air/water mixture into a fine liquid water mist having a high flow rate and a long projection, as well as a centerline concentration of liquid water droplets measuring from about 150 microns and smaller. It has been discovered that larger droplet sizes, above about 150 microns, tend to collect within conduit sections that make bends or turns. The collected water is then carried along the conduit with the mist and expelled at the mist discharges 26 where the water puddles within the interior space 3. Such puddling conditions are contrary to the primary object of this invention in that it is important to eliminate water from the interior space in order to avoid the possibility of steam explosions.

In the preferred embodiment, a LECHLER 171.121.17 SUPERSONIC SPRAY NOZZLE is used to generate a mist having a centerline concentration of liquid water droplets. However, any equivalent atomizing apparatus can be used to produce the mist without departing from the scope of this invention.

In addition, in actual reduction to practice, the LECHLER nozzle produces a mist having liquid water droplets measuring up to about 150 microns. In keeping with the teaching of this invention, water droplet size is not nearly as important as the need to prevent the mist from collecting and forming pools within the trunnion ring. Therefore, the mist that is discharged into the trunnion ring can comprise any liquid water droplet size that avoids excessive water collection and puddling within the trunnion. In the event that some puddling and/or condensation takes place within the interior space 3, weep holes 49 extend through the bottom flange 7 to discharge any condensed water from the trunnion ring interior space.

The mist is discharged from nozzle 23 through a feed line 36 that extends between the supersonic nozzle and the header 24 located in the idle side trunnion 4 of the BOF support structure. A swivel joint 38 located along the feed line compensates for trunnion rotation during furnace operations.

Header 24 divides and distributes the incoming mist into a pair of conduit systems 39 and 40 that extend along opposite sides of the interior space 3 of the trunnion ring. The first conduit system 39 includes a discharge pipe 41 having a first mist discharge 43 proximate the trunnion block 10 on the idle side of the furnace, and a second mist discharge 45 proximate trunnion block 11 on the drive side 9. An intake fitting 47 positioned between the first and second mist discharge 43 and 45 is attached to header 24 to receive the incoming mist.

Similarly, the second conduit system 40 includes a discharge pipe 42 having a first mist discharge 44 proximate the side of trunnion block 10 opposite the mist discharge 43, and a second mist discharge 46 proximate the side of trunnion block 11 opposite the mist discharge 45. Discharge pipe 42 also has an intake fitting 48 positioned between the first and second mist discharge 44 and 46 to receive the incoming mist from header 37.

When the mist is discharged from conduits 39 and 40 against the hot trunnion blocks 10 and 11 (300° F. or higher), the high temperature causes a phase change and the mist is instantaneously vaporized into steam. The heat transfer of vaporization cools the trunnion ring and the steam moves toward vents where it is exhausted into the atmosphere. As the steam moves toward the steam vents, it picks up additional heat from the surrounding interior surfaces of the trunnion ring, further reduces trunnion ring temperature, and maintains a relatively uniform temperature within the trunnion ring.

The steam vent systems 49 and 50 are located along opposite sides of the trunnion ring 2. The vents are positioned between the first and second mist discharges in the conduit systems 39 and 40, and the vents extend through the outside web 5 of the trunnion ring to communicate with the inside space 3. Each steam vent pipe, in the vent systems 49 and 50, includes an open end positioned adjacent the inside surface 4*a* of inside web 4, and a second open end positioned outboard of the outside web 5. The close proximity of the vent openings, next to the surface 4*a,* forces the steam or vapor to travel along or near the inside wall 4*a* as it moves from each mist discharge 26 toward the vents. The steam flow path along the inside wall 4*a* facilitates heat transfer from the hot web 4 to the steam.

In order to duplicate the heat sink effect achieved in a water-cooled trunnion ring, where the radiant heat emitted from the outside shell of the hot BOF vessel is transferred into the cooling water, the heat transfer of vaporization must cool the trunnion ring to a temperature of about 600° F. or lower. Additionally, it is extremely important to maintain a small temperature differential between the inside web 4 and the outside web 5 in order to reduce thermal stress in the trunnion ring. A temperature differential of about 100° F. or lower reduces the potential for thermal shock failure. As heretofore discussed, when there is a small temperature differential between the spaced apart webs, differential expansion in the trunnion ring is diminished, and failure from thermal shock is either eliminated or reduced.

As disclosed in Table A below, in actual reduction to practice, the preferred cooling apparatus 20 effectively cools a BOF trunnion ring well below the maximum 600° F. temperature level and it also maintains a 100° F. or lower temperature differential between the spaced apart trunnion ring webs. Table A shows actual temperature measurements that were periodically taken at a BOF steelmaking operation where the trunnion ring was cooled using the present cooling apparatus invention. The inside web temperatures were recorded using pyrometer sightings taken through the steam vent pipes in the vents 49 and 50, and pyrometer readings were also taken along the outside web 5, adjacent the vent pipes. Multiple temperatures were recorded at each location and the average temperature was entered into Table A. For example, on the north side of the vessel, shown in FIG. 1, temperature readings were taken through both vent pipes and the two temperatures measurements were averaged to provide an inside web temperature recorded in Table A. Similarly, three temperature readings were taken along the outside web 5, adjacent the steam vents 49, and their average was entered into Table A. The same procedure was used to record temperature on the south side of the vessel.

Although the cooling apparatus 20 is shown comprising a single supersonic nozzle 23 and a single header 24 for distributing mist through the idle side trunnion pin 4 and into opposite hand conduit arrangements that extend along the opposite sides of the trunnion ring 2, the cooling system could just as well comprise an equivalent mist distribution arrangement that introduces mist through both the idle side trunnion pin 4 and the drive side trunnion pin 5 without departing from the scope of this invention.

As such, the invention has been disclosed in terms of preferred embodiments thereof which fulfill each and every one of the objects of the present invention as set forth above and provides a new and improved apparatus and method for cooling the temperature of a structure adjacent a hot mass such as refining vessel or furnace.

While this invention has been described as having a preferred design, it is understood that the invention is capable of further modifications, uses, and/or adaptations which follow in general the principle of the invention and includes such departures from the present disclosure as come within known or customary practice in the art to which the invention pertains and that may be applied to the central features hereinbefore set forth and fall within the scope of the limits of the appended claims.

| | North Side Temperatures °F. | | | South Side Temperatures °F. | | |
|---|---|---|---|---|---|---|
| Temp. Date | Inside Web Temp. | Outside Web Temp. | Temp. Diff. | Inside Web Temp. | Outside Web Temp. | Temp. Diff. |
| June 3, 1997 | 214 | 245 | 31 | 265 | 306 | 41 |
| June 9, 1997 | 230 | 228 | 2 | 331 | 283 | 48 |
| June 13, 1997 | 240 | 213 | 27 | 350 | 383 | 34 |
| June 18, 1997 | 300 | 307 | 7 | 445 | 385 | 60 |
| June 19, 1997 | 287 | 307 | 20 | 403 | 340 | 63 |
| June 20, 1997 | 279 | 313 | 35 | 421 | 388 | 33 |
| June 27, 1997 | 337 | 320 | 17 | 465 | 395 | 69 |

We claim:

1. In a BOF trunnion ring supporting a BOF vessel, the trunnion ring having an interior space defined by spaced apart webs, a top flange, a bottom flange and transverse stiffeners extending between the spaced apart webs, an improved cooling apparatus comprising:

a) a nozzle to generate a water mist;

b) at least one conduit extending from said nozzle and communicating with the interior space of the trunnion ring, said conduit having at least one discharge to disperse said water mist into the interior space, said water mist being vaporized by contact with a hot surface in the interior space, the heat transfer of vaporization cooling the trunnion ring; and c) at least one vent to discharge said vapor from the interior space.

2. The apparatus recited in claim 1 comprising:

a) a header that receives and distributes said water mist generated by said nozzle;

b) a first conduit extending along a portion of the interior space of the trunnion ring, said first conduit receiving a measure of said water mist distributed by said header, and said first conduit including at least one discharge to disperse said measure of water mist into the interior space of the trunnion ring; and c) a second conduit extending along a portion of the interior space of the trunnion ring opposite said first conduit, said second conduit receiving a measure of said water mist distributed by said header, said second conduit including at least one discharge to disperse said measure of water mist into the interior space opposite said first conduit.

3. The apparatus recited in claim 2 wherein:

a) said first conduit includes a first discharge located adjacent an idle trunnion pin block within the interior space, and a second discharge located adjacent a drive trunnion pin block within the interior space; and b) said second conduit includes a first discharge located adjacent the idle trunnion pin block on a side opposite said first conduit, and a second discharge located adjacent the drive trunnion pin block on a side opposite said first conduit.

4. The apparatus recited in claim 1 comprising:

a) a water supply attached to said nozzle to generate a water mist having water droplets measuring in size up to about 150 microns.

5. The apparatus recited in claim 1 comprising:

a) a water supply attached to said nozzle to provide a water flow rate to said nozzle of at least about 5 gallons per hour; and b) an air supply attached to said nozzle to provide an air flow rate to said nozzle of at least about 75 SCFM and at a pressure of at least about 20 psi.

6. The apparatus recited in claim 5 wherein:

a) said water supply provides a water flow rate to said nozzle of about 15 gallons per hour; and b) said air supply provides an air flow rate to said nozzle of about 100 SCFM and at a pressure of about 30 psi.

7. The invention recited in claim 1 wherein said at least one vent includes at least one conduit communicating with the interior space of the trunnion ring, said at least one conduit having a first end adjacent the spaced apart web nearest the BOF vessel and a second end located outboard of the trunnion ring to discharge said vaporized water mist from the interior space.

8. The invention recited in claim 7 comprising two vents spaced apart along opposite sides of the trunnion ring, each vent including at least one conduit communicating with the interior space of the trunnion ring, said at least one conduit having a first end adjacent the spaced apart web nearest the BOF vessel and a second end located outboard of the trunnion ring to discharge said vaporized water mist from the interior space.

9. The invention recited in claim 1 wherein said bottom flange includes weep holes that extend through said bottom flange to provide drains.

10. A method of cooling a BOF trunnion ring supporting a BOF vessel, the trunnion ring having an interior space defined by spaced apart webs, a top flange, a bottom flange and transverse stiffeners extending between the spaced apart webs, the steps of the method comprising:

a) providing a water mist source;

b) injecting said water mist into the interior space;

c) vaporizing said water mist discharged into the interior space so that the heat transfer of vaporization cools the trunnion ring; and d) venting the vaporized water mist from the trunnion ring.

11. The method recited in claim 10 including the further step of injecting said water mist against a hot surface within the interior space prior to vaporizing.

12. The method recited in claim 11 wherein said water mist contacts an idle trunnion pin block within the interior space and a drive trunnion pin block within the interior space.

13. The method recited in claim 1 wherein said water mist comprises water droplets measuring in size up to about 150 microns.

14. The method recited in claim 10 wherein said water mist is injected into the interior space through a conduit system comprising:

a) a header that receives and distributes said water mist;

b) a first conduit extending along a portion of the interior space of the trunnion ring, said first conduit receiving a measure of said water mist distributed by said header, and said first conduit including at least one mist discharge to disperse said measure of water mist into the interior space of the trunnion ring; and c) a second conduit extending along a portion of the interior space of the trunnion ring opposite said first conduit, said second conduit receiving a measure of said water mist distributed by said header, and said second conduit including at least one mist discharge to disperse said measure of water mist into the interior space opposite said first conduit.

15. The method recited in claim 10 wherein said water mist source comprises:

a) a nozzle for generating said water mist;

a) a water supply to said nozzle at a flow rate of at least about 5 gallons per hour; and b) an air supply to said nozzle at a flow rate of at least about 75 SCFM and at a pressure of at least about 20 psi.

16. The method recited in claim 10 wherein said water mist source comprises:

a) a nozzle for generating said water mist;

b) a water supply to said nozzle at a flow rate of about 15 gallons per hour; and c) an air supply to said nozzle at a flow rate of about 100 SCFM and at a preferred pressure of about 30 psi.

17. A trunnion ring cooling device comprising:

a) a nozzle to generate a water mist;

b) at least one conduit extending from said nozzle to dispense said water mist into an interior space of the trunnion ring, said water mist being vaporized within the interior space; and c) at least one vent to exhaust vapor from the interior space.

18. The apparatus recited in claim 17 comprising:

a) a header that receives and distributes said water mist generated by said nozzle; and b) at least two conduits extending from said header to dispense said water mist within the interior space of the trunnion ring.

19. The apparatus recited in either claim 17 or claim 18 comprising:

a) a water supply attached to said nozzle to generate a water mist having water droplets measuring in size up to about 150 microns.

20. The apparatus recited in claim 19 comprising:

a) a water supply attached to said nozzle to provide a water flow rate to said nozzle of at least about 5 gallons per hour; and b) an air supply attached to said nozzle to provide an air flow rate to said nozzle of at least about 75 SCFM and at a pressure of at least about 20 psi.

21. The apparatus recited in claim 19 comprising:

a) at least one drain positioned to discharge water from the interior space of the trunnion ring.

22. A method of cooling a trunnion ring, the steps comprising:

a) injecting a water mist into an interior space within the trunnion ring;

b) vaporizing at least some of the water mist within the interior space, the heat transfer of vaporization cooling the trunnion ring; and c) exhausting vapor from the interior space.

23. The method recited in claim 22 including the further step of injecting said water mist against a hot surface within the interior space prior to vaporizing.

24. The method recited in claim 22 wherein step (a) includes injecting a mist comprising water droplets measuring in size up to about 150 microns.

25. The method recited in claim 22 including the further step of mixing a flow from a water supply with a flow from an air supply to provide said water mist injected into the interior space.

26. The method recited in claim 25 wherein:

a) said water flow is at a rate of at least about 5 gallons per hour; and b) said air flow is at a rate of at least about 75 SCFM at a pressure of at least about 20 psi.

27. The method recited in claim 24 wherein:

a) said water flow is at a rate of about 15 gallons per hour; and b) said air flow is at a rate of about 100 SCFM at a pressure of about 30 psi.

28. The method recited in claim 22 including the further step of draining water from the interior of the trunnion ring.

* * * * *

UNITED STATES PATENT AND TRADEMARK OFFICE

CERTIFICATE OF CORRECTION

PATENT NO. : 5,853,656

DATED : December 29, 1998

INVENTOR(S) : Besterman, et al.

It is certified that error appears in the above-indentified patent and that said Letters Patent is hereby corrected as shown below:

In the Detailed Description of the Preferred Embodiment

Column 4, line 48, correct "mist from header 37." to read -- mist from header 24. --

In the Drawings

Figure 1:
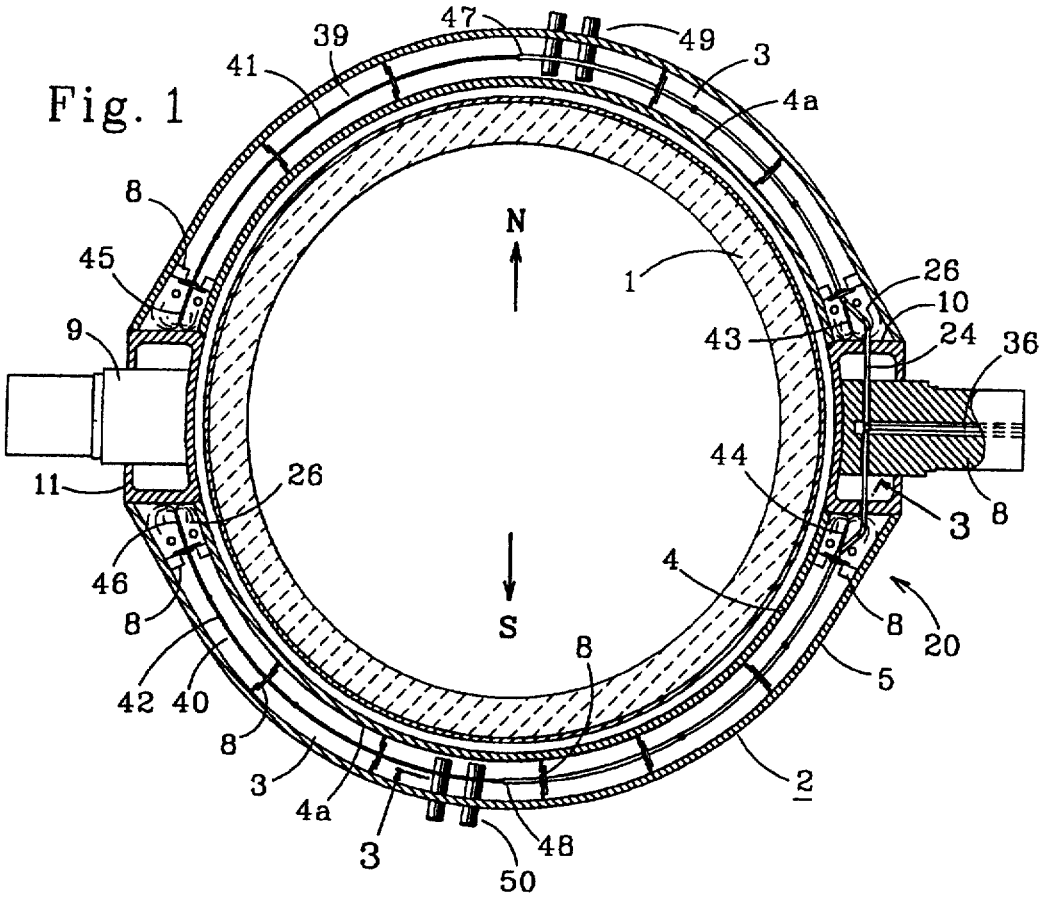
FIG. 1 is a plan view showing the cooling apparatus of the present invention installed in the trunnion ring of a metallurgical vessel.

Delete Figure 1 and substitute Figure 1 as shown on the attached page.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*